United States Patent [19]

Mizuta

[11] Patent Number: 4,725,809

[45] Date of Patent: Feb. 16, 1988

[54] VARIABLE RESISTOR AND SWITCH

[75] Inventor: Yukio Mizuta, Aichi, Japan

[73] Assignee: Kabushiki Kaisha Tokai Rika Denki Seisakusho Seisakusho, Aichi, Japan

[21] Appl. No.: 914,355

[22] Filed: Oct. 2, 1986

[30] Foreign Application Priority Data

Oct. 2, 1985 [JP] Japan ..... 60-151830[U]

[51] Int. Cl.[4] ..... H01C 10/38

[52] U.S. Cl. ..... 338/179; 338/198; 338/200

[58] Field of Search ..... 338/176, 179, 198, 200, 338/201

[56] References Cited

U.S. PATENT DOCUMENTS 1,559,427 10/1925 Hemphill ..... 338/198 X
2,214,659 9/1940 Dardess ..... 338/198
2,247,841 7/1941 Kamenarovic ..... 338/179
3,312,925 4/1967 Frantz ..... 338/200

*Primary Examiner*—C. L. Albritton
*Attorney, Agent, or Firm*—Finnegan, Henderson, Farabow, Garrett, and Dunner

[57] ABSTRACT

An electrical device that includes a variable resistor and a switch mechanism. The variable resistor has a control element disposed to be moved linearly to change the electrical resistance of the device according to the position of the control element. A switch is positioned adjacent the variable resistor and the switch includes a movable contact holder having a first electrical contact mounted thereon. A second electrical contact is positioned in the switch such that movement of the contact holder selectively brings the first electrical contact into contact with the second electrical contact. An actuator moves the movable contact holder when the control element is at one extremity of a linear movement.

5 Claims, 3 Drawing Figures

VARIABLE RESISTOR AND SWITCH

FIELD OF THE INVENTION

This invention relates to a variable resistor with a switch and more particularly to such a variable resistor whose operation and switching function are performed by one and the same control knob.

BACKGROUND OF THE INVENTION

Variable resistors that include a switch are generally rotary actuated where the operating shaft of the switch is movable in the axial direction with one end projecting from the body of variable resistor switch. The one end of the operating shaft is used to actuate a contact type switch.

A linearly actuated variable resistor may be employed in place of the rotary actuating type variable resistor for certain types of equipment. In such applications the control knob for such a linearly actuated variable resistor allows a relatively large moving stroke and thus convenience in use because a look at the position of the control knob is sufficient to check a set value. As a consequence, there has been a demand for a variable resistor with a switch, which is a combination of a linearly actuated variable resistor and a switch mechanism.

Even though an attempt may be made to provide the linearly actuated variable resistor with a switch mechanism by providing a rotary switch mechanism, the large moving stroke characteristic of the control knob of the linear resistor portion has made it difficult to implement the attempt. As a matter of fact, a linear variable resistor in combination with a switch mechanism, is not known to be available.

Thus, one object of the present invention is to provide a linear variable resistor with a switch capable of providing both the function of a switch and the conveniences of a linearly actuated variable resistor.

SUMMARY OF THE INVENTION

In order to achieve these and other objects of the invention, there is provided an electrical device that includes a variable resistor means and a switch means. The variable resistor means has a control element disposed to move linearly to change the electrical resistance of the device according to the position of the control element as well as means to move the control element. The switch means is positioned adjacent the variable resistor means and includes a movable contact holder having a first electrical contact mounted thereon. A second electrical contact is positioned in the switch means such that movement of the contact holder selectively brings the first electrical contact into contact with the second electrical contact. The device further includes actuating means for moving the movable contact holder against the spring means with the actuating means moving the movable contact holder when the control element is at one extremity of its linear movement. Preferably, the device includes means for controlling linear movement of the control element that comprise a case adjacent the control element and a spring biased ball member mounted in the control element disposed to engage openings in the case. It is further preferred that the actuating means comprise a rod projecting from the control element with the rod being disposed to engage and move the movable contact holder.

DESCRIPTION OF THE PREFERRED EMBODIMENT

Referring now to the accompanying drawings, there will be described an embodiment of the present invention applied to a collection of light switches arranged on a vehicular instrument panel.

Figure 2:
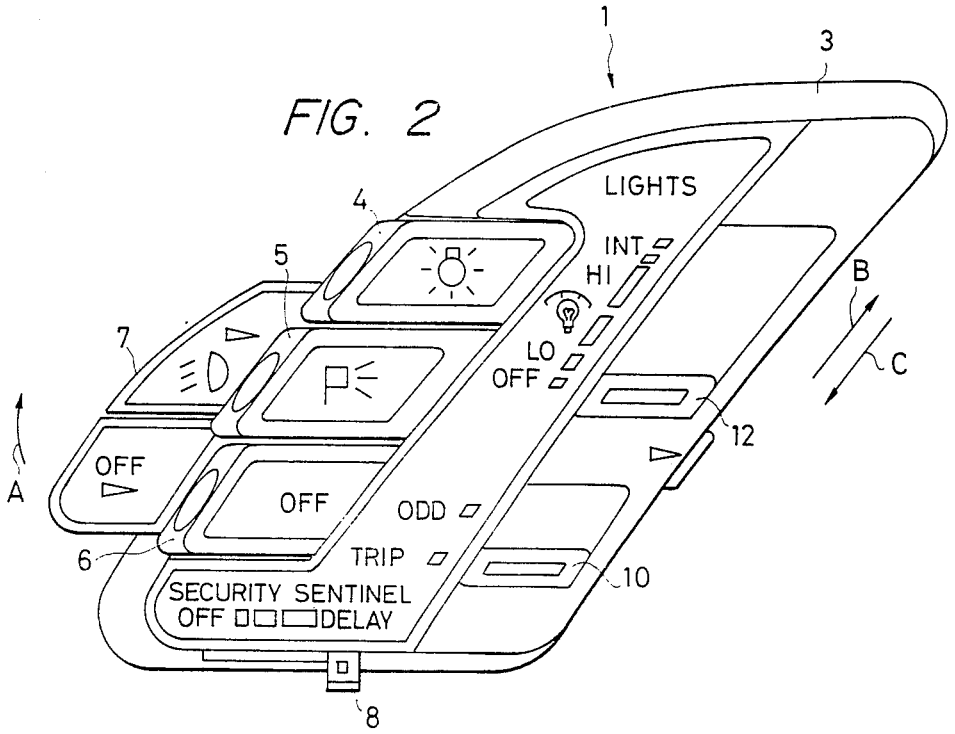
FIG. 2 is an elevational view of a device including the embodiment of FIG. 1.
Figure 3:
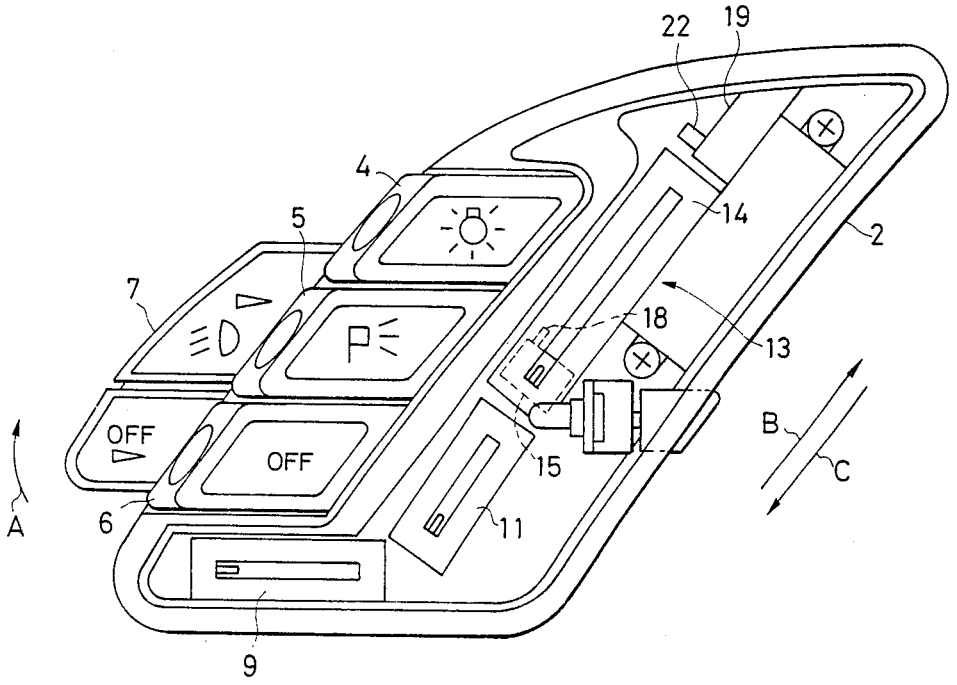
FIG. 3 is an elevational view of the device of FIG. 2 excluding the switch case.

FIGS. 2 and 3 depict a switch body 1 covered by a switch case 2 having a switch cover 3 arranged to the left of a vehicular steering column (not shown). Of first through third control buttons 4–6 and a control plate 7, the first through third control buttons 4–6 are arranged vertically in three tiers on the left of the switch case 2. The control buttons 4–6 are operated when pressed to the right and are used for lighting a head lamp, a small lamp and switching the lamps off. The control plate 7 is rotatably mounted in an area close to the upper left end of the switch body 1. When it is rotated in the direction of an arrow A, a fog lamp is lit and unlit when it is turned in the direction opposite to the arrow A.

A delay time setting knob 8 is used to actuate a linearly actuated variable resistor installed in the switch body 1. When the ignition key is pulled out while the head lamp is lit, the delay time setting knob 8 sets the delay time until the lamp is automatically unlit. A meter display changeover knob 10 is used to actuate a slide switch 11 installed in the switch body 1 and selectively switches on a total or trip odometer on the meter panel.

An illumination adjusting knob 12 is used to adjust the illumination of a lamp and changes the resistance value of a linearly actuated variable resistor 13 installed in the switch body 1 when it is moved in the direction of an arrow B or C. As shown in FIG. 3, the variable resistor 13 includes a control element 15 contained in a slender case 14 with the control element being linearly movable along the arrow B or C with the resistance value of the variable resistor being changed in relation to the position of the control element 15.

Figure 1:
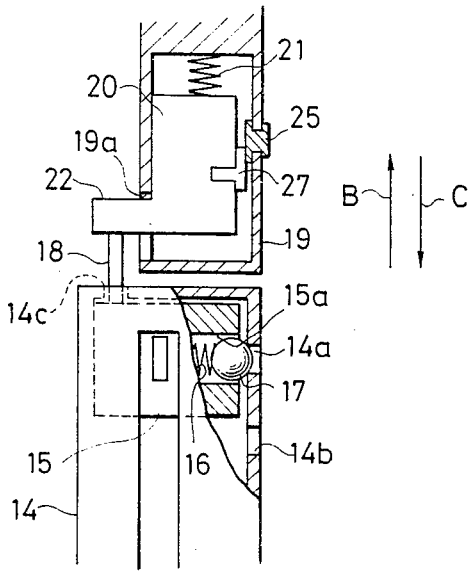
FIG. 1 is a partial cross-section view of the principal portion of a variable resistor embodying the present invention.

As shown in FIG. 1, a plurality of openings **14*a*, 14*b* and 14*c* are formed in the side wall of the case 14. A compression spring 16 and a ball 17 are contained in a hole formed in the control element 15. The ball 17 is always biased by the compression spring 16 toward the side of the case 14 containing the openings 14*a* and 14*b*, so that the movement of the control element 15 is controlled. An actuator rod 18 is incorporated with the control element 15 and projects toward the one end face of the case 14. When the control element 15 is moved to what is termed the "marginal position" in the direction of the arrow B, the actuator rod 18 is protruded from the case 14 through a hole 14*c* formed in the edge face thereof and allowed to reach a working position. By the marginal position of movement of the control element 15 in the direction of the arrow B, it is meant that a position where the ball 17 is caused to engage the opening 14*a* as the control element 15 is positioned at the upper end of the case 14 by moving the illumination adjusting knob 12 in the direction of the arrow B to the display position "INT" shown in FIG. 2**.

A switch housing 19 is fixed to the switch case 2 and contains a contact holder 20, which is movable in the same direction in which the control element 15 of the variable resistor 13 is moved. The switch housing 19 and the contact holder 20 are equipped with a fixed contact 25 and a moving contact 27 for changing the state of contact as the contact holder 20 moves. The contact holder 20 is biased by a compression spring 21 in the direction of the arrow C and provided with a projection 22 projecting through the side wall of the switch housing 19 through an opening 19*a* formed therein. The projection 22 projects from the contact holder 20 at a position where it is contacted by the actuator rod 18.

In the variable resistor 13 thus constructed, the control element 15 is caused to move by operating the illumination adjusting knob 12 in the direction of the arrow B or C, so that its resistance value changes. Since the change of the resistance value is proportional to the position of the control element 15, a look at the illumination adjusting knob 12 is enough to confirm easily the value set. The variable resistor 13 is thus convenient to use. When the control element 15 is moved to the marginal position of movement completely in the direction of the arrow B, the actuator rod 18 of the control element 15 is moved to the working position shown in FIG. 1 and the ball 17 of the control element 15 engages upper opening 14*a*, whereby the control element 15 is locked in that position. The projection 22 is pressed by the actuator rod 18 located in the working position, whereas the contact holder 20 resists against the elastic force of the compression spring 21 and moves in the direction of arrow B, thus changing the state of contact between the fixed and moving contacts in the contact holder 20. As a consequence, the interior lamp inside the vehicle is lit. It is thus possible to open or close the contacts (e.g., 25 and 27) at one end of a series of operations of the illumination adjusting knob 12 without impairing the advantage of the linearly actuated variable resistor because a set value is confirmable with a glance at the knob position. That advantage makes the variable resistor 13 more convenient to use.

Although the actuator rod 18 is shown incorporated with the control element 15 in the above embodiment, the present invention is not limited to such an arrangement and the actuator rod may project from the contact holder 20 or be installed movably in the case of the variable resistor 13.

As set forth above, the switch contacts are opened and closed by moving the contact holder together with the actuator means until the control element of the variable resistor is moved to what is termed the marginal position of movement. The variable resistor with a switch according to the present invention offers the excellent practical effect by which the switch is operated or released by the same control knob while the convenience of the linearly actuated variable resistor is utilized.

The present invention has been disclosed in terms of a preferred embodiment. The scope of the invention is not limited thereto and is determined solely by the appended claims and their equivalents.

What is claimed is:

1. An electrical device including variable resistor and switch device comprising:

linear variable resistor means having a control element disposed to move linearly in a predetermined direction to change the electrical resistance of said device according to the position of said control element;

means for moving said control element linearly in said predetermined direction;

switch means positioned adjacent said variable resistor means, said switch means including a movable contact holder having a movable contact mounted thereon, and at least one fixed contact positioned in said switch means such that movement of said movable contact holder selectively brings said movable contact into contact with said fixed contact; and actuating means for moving said movable contact holder in said predetermined direction when said control element is at one extremity of the linear movement.

2. The device of claim 1 wherein said device includes means for controlling linear movement of said control element comprising a case adjacent said control element and spring-biased ball members mounted in said control element disposed to engage openings in said case.

3. The device of claim 2 wherein said case is linearly elongated and said openings are adjacent one end of said case.

4. The device of claim 1 wherein said actuating means comprises a rod projecting from said control element, said rod being disposed to engage and move said movable contact holder.

5. The device of claim 4 wherein said movable contact holder includes a projection disposed to contact said rod.

* * * * *